US006755261B2

(12) United States Patent
Koederitz

(10) Patent No.: US 6,755,261 B2
(45) Date of Patent: Jun. 29, 2004

(54) METHOD AND SYSTEM FOR CONTROLLING WELL FLUID CIRCULATION RATE

(75) Inventor: William L. Koederitz, Cedar Park, TX (US)

(73) Assignee: VARCO I/P, Inc., Houston, TX (US)

( * ) Notice: Subject to any disclaimer, the term of this patent is extended or adjusted under 35 U.S.C. 154(b) by 0 days.

(21) Appl. No.: 10/113,631

(22) Filed: Mar. 7, 2002

(65) Prior Publication Data

US 2003/0168258 A1 Sep. 11, 2003

(51) Int. Cl.[7] ..... E21B 21/10
(52) U.S. Cl. ..... 175/25; 175/38; 175/48
(58) Field of Search ..... 175/25, 38, 48, 175/24, 40

(56) References Cited

U.S. PATENT DOCUMENTS 4,393,485 A * 7/1983 Redden ..... 175/40
6,378,628 B1 * 4/2002 McGuire et al. ..... 175/48
6,474,422 B2 * 11/2002 Schubert et al. ..... 175/38
6,484,816 B1 * 11/2002 Koederitz ..... 175/25
6,575,244 B2 * 6/2003 Chang et al. ..... 175/25
6,607,042 B2 * 8/2003 Hoyer et al. ..... 175/38
6,648,081 B2 * 11/2003 Fincher et al. ..... 175/25

* cited by examiner

*Primary Examiner*—David Bagnell
*Assistant Examiner*—Matthew J Smith
(74) *Attorney, Agent, or Firm*—Browning Bushman P.C.

(57) ABSTRACT

Methods and systems are provided for varying fluid pressure in a circulation system while circulating a kick out of a well bore 30 drilled through a subterranean formation using a drilling rig 25 and a drill string 50. The kick may be automatically circulated out of the well bore and/or a kill fluid may be circulated into the well bore. A controller 100 reduces the circulation rate by automatically controlling the rate of the pump 90 and the position of well bore choke 70. Various sensors interconnected with the controller may be used to maintain circulation system operation. The controller may control various components utilized in the circulation procedure to maintain a substantially constant bottom hole pressure on the formation while circulating the kick out of the well.

13 Claims, 2 Drawing Sheets

METHOD AND SYSTEM FOR CONTROLLING WELL FLUID CIRCULATION RATE

FIELD OF THE INVENTION

The present invention relates to drilling subterranean well bores of the type commonly used for recovery of oil or gas. More particularly, this invention relates to an improved method and system for automatically reducing the well fluid circulation rate while circulating a kick out of a well in response to one or more of a plurality of monitored well or surface equipment conditions relating to the fluid circulation system.

BACKGROUND OF THE INVENTION

Drilling subterranean wells typically includes circulating a drilling fluid ("mud") through a fluid circulation system. The circulation system typically includes a drilling rig and mud treating equipment located substantially at or near the surface of the well. The drilling fluid may be pumped by a mud pump through the interior passage of a drill string, through a drill bit and back to the surface through the annulus between the well bore and the drill pipe.

A primary function of drilling mud is to maintain hydrostatic fluid pressure control of fluids in the formations penetrated by the well bore. Weighting agents may be added to a mud to achieve the desired mud density. Overbalanced drilling techniques typically practice maintaining a hydrostatic fluid pressure in the well bore and on the formation equal to or slightly overbalanced with respect to formation fluid pressure ("pore pressure"), both when circulating and when not circulating the mud. In underbalanced drilling techniques, hydrostatic pressure in the well bore is maintained at least slightly lower than formation pore pressure by the mud, supplemented with surface well control equipment. If the well bore encounters a zone having a substantially higher pore pressure than the hydrostatic fluid pressure in the mud, an influx of formation fluid may be introduced into the well bore. Such occurrence is known as taking a "kick."

When a kick is taken, the invading formation liquid and/or gas may "cut" the density of the drilling fluid in the well bore annulus, such that as more formation fluid enters the well bore, hydrostatic control of the well bore may be lost. Such occurrence may be noted at the drilling rig in the form of a change in pressure in the well bore annulus, changes in mud density, and/or a gain in drilling fluid volume in the mud system tanks ("pit volume"). When a kick is detected or suspected, mud circulation is conventionally halted and the well bore closed in/shut in to measure the pressure buildup in the well bore annulus, pit gain and shut in drill pipe pressure. Appropriate well-killing calculations may also be performed while the well is closed in. Thereafter, a known well killing procedure may be followed to circulate the kick out of the well bore, circulate an appropriately weighed mud ("kill mud") into the well bore, and ensure that well control has been safely regained. When a circulated kick enters long, narrow, and/or restrictive choke lines, such as may be encountered with a deepwater floating rig, the operator may anticipate this condition and briefly shut in the well.

Typically, the intent of the operator while circulating a kick out of a well is to hold pump rate constant at a normal or high rate, and only change the pump rate if an excessive or undesirable condition arises. It is common practice during the course of drilling the well bore to frequently measure and record the slower mud pump rates and corresponding pump circulation pressures required to circulate the mud. These slow mud pump rates, e.g., about one-half to one-third of the normal circulation rate while circulating a kick out of a well, may be used to more slowly and carefully circulate the kick out of the well bore. The cumulative number of pump strokes from a mud pump or a plurality of mud pumps required to circulate the hole may thus be measured or assumed, and is generally known to the well operator.

One of the most common techniques for killing the well and circulating an appropriate kill fluid is the "constant bottom hole pressure" method, whereby bottom hole pressure may be maintained substantially at or above formation pore pressure. Two variations of this method exist: the Driller's method and the Wait and Weight method. The Driller's method may be utilized when kill weight fluid is not yet available for circulation. In the Driller's method, the original mud weight may be used to circulate the contaminating fluids from the well bore. Thereafter, kill weight mud ("KWM") may be circulated into the drill pipe and the well bore. Although two circulations may be required to effectuate the Driller's method, this method may be quicker than the subsequently discussed variation.

In the Wait and Weight or "Engineers" method, KWM is prepared and then circulated down the drill string and into the well bore to remove the contaminating fluids from the well bore and to kill the well, in one circulation. This method may be preferable to maintain the lowest casing pressure during circulating the kick from the well bore and may thereby minimize the risk of damaging the casing or fracturing the formation and creating an underground blowout.

A substantially constant bottom hole pressure may be maintained in both methods. In both methods, pressure within the casing and/or drill pipe may be controlled by adjusting a choke conducting mud from the well to a mud reservoir. To further control pressure, the mud pump rate may be maintained at one of the previously measured or assumed low or reduced circulation rates. In the Driller's method, a constant drill pipe pressure may be maintained during the first circulation, which may include the shut in drill pipe pressure ("SIDPP") plus the slow rate pump pressure, plus a nominal safety factor, e.g., fifty psig. During the second circulation, the casing pressure may be held constant while the KWM is circulated to the bit, and then the drill pipe pressure held constant while the KWM is circulated from the bit to the surface. In the Wait and Weight method, a substantially constant bottom hole pressure may be maintained during the one circulation of KWM. KWM may be circulated down the drill string while maintaining drill pipe pressure at a calculated, predetermined pressure while the mud pump is maintained at a constant rate. The drill pipe pressure may gradually decrease as KWM is circulated to the bit. After KWM reaches the bit, the drill pipe pressure may be held constant until the KWM reaches the surface. A combination method is known which may combine portions of each of the above two methods. After the well is shut in and the pressures recorded, pumping of original weight mud may begin while the original weight mud is being weighted up to KWM, as the kick is being pumped out of the well bore.

Each of the above methods may be time consuming and may require extensive planning, calculations, monitoring, human intervention and/or coordinated regulation of components, rates and pressures during execution of the respective method. In addition, each method preferably uses a substantially constant pump rate (reduced circulation rate) in order to maintain control of the process during execution of the respective method, hopefully while maintaining a substantially constant bottom hole pressure. The Wait and Weight method also may require constructing a graphical or tabular pumping schedule of pump pressure versus volume pumped. In the event it becomes necessary to change pumping rates and/or interrupt pumping while executing the procedure to circulate the kick out of the well, it frequently may be necessary to record new shut in and circulating pressures, and recalculate a new pumping and/or pressure schedule. While circulating a kick out of the well, it is common for the drilling operator to monitor a plurality of signals relating to the fluid circulation system and, in response to one or more of those signals exceeding on an acceptable limit, the operator shuts the well back in and restarts the procedure of circulating the kick out of the well.

Following completion of the kill procedure, new pressure readings should be taken, wherein the well may be under hydrostatic control, such that the casing pressure may read substantially zero psig. A failure to maintain a constant bottom hole pressure may result from miscommunication, erroneous operation of the choke, procedural miscalculations, and/or other inappropriate equipment operation during the procedure. SPE paper 19245 by J. M. Prieur describes various well control issues in high temperature/high pressure wells. An article in SPE Drilling Engineer, December 1991, discloses sizing of a mud-gas separator to avoid problems.

The operator of a well fluid circulation system is in control of a facility where safety is paramount, and where an unnecessary shut down may be very costly. In many situations, the operator knows and understands the "feel" of the well during the procedure to circulate out the kick of the well and, based on prior experience, is able to predict well operations with a similar set of symptoms. Shutting in a well for several hours while circulating a kick out of a well may cost thousands of dollars, and commonly leads to other problems, including excessive pressure and lost circulation to the formation, and reduced pressure which abruptly increases when a kick comes in. Rather than shut in a well during the procedure for circulating a kick out of a well after the well is shut in (or substantially shut in), particularly under circumstances where it is not necessary to shut in the well, it is preferable to keep the well circulating at a reduced rate.

The drilling operator is responsible for controlling the mud pumps, the chokes, and other surface equipment which affect fluid circulation. The drilling operator also serves a diagnostic function when complications or potential problems in a well are sensed. The drilling operator also is involved in managing well conditions, including various temperature, pressure, and flow rate conditions. The amount of human intervention required, including the substantial gathering of pump rate and pressure information, calculating and scheduling a kill procedure, maintaining a constant pump rate, and coordinating the operation of equipment to maintain the appropriate surface pressures and constant bottom hole pressure, are disadvantages of the prior art. An improved method and system for more accurately and reliably controlling well fluid circulation rate when circulating a kick out of a well are described below.

The present invention provides the operator with increased assurance that the circulation rate will be automatically reduced to a predetermined circulation rate in the event that a monitored condition exceeds an acceptable value. Prior performance of the well at that predetermined reduced circulation rate will provide further confidence to the drilling operator with respect to both the reduced circulation rate and the subsequent increase in circulation rate once the problem is eliminated.

SUMMARY OF THE INVENTION

A control system is provided to monitor one or more selected drilling parameters and provide automated control to reduce the fluid circulation rate to a selected value while circulating a kick out of a well based on the monitored parameters. The control system may monitor selected pressures, pump rates, choke position, pit volumes in the mud system, alarm conditions, lost circulation detectors, bit nozzle plugging detectors, choke washout detectors, mud-gas separation system operation, and/or sensor failure. When a potential problem is detected, i.e., a sensed condition rises above or falls below an acceptable value, the control system may be used to automatically reduce the fluid circulation rate while circulating the kick out of the well. In addition, the control system may facilitate returning the circulation rate to the normal rate in response to changes or interruptions in the pumping operation while circulating the kick out of the well.

It is an object of this invention to provide methods and systems for reducing the fluid circulation rate to a predetermined rate in response to monitored parameters while circulating a kick out of a well.

It is an object of the invention to provide an improved method of varying fluid pressure in a circulation system while circulating a kick out of the well. The circulation system conventionally includes a well bore drilled through a subterranean formation using a drilling rig, a drill string having a through bore and positioned at least partially within the well bore, a fluid pump for pumping a fluid through the drill string and into the well bore, and a drilling fluid choke in fluid communication with an annulus of the well bore. The method includes pumping of fluid through the drill string, then through the well bore annulus and substantially back to the drilling rig, with the fluid being pumped at a desired fluid circulation rate while circulating the kick out of the well. A plurality of sensors are used to monitor conditions of the circulation system while pumping the fluid. In response to the monitored conditions, the fluid circulation rate is automatically reduced to a predetermined reduced circulation rate.

It is a related object of the invention to provide an improved system for varying fluid pressure in a circulation system. The controller is responsive to a plurality of sensors for sensing conditions relating to the fluid circulation system, and automatically reduces the fluid pressure in the circulation system to a predetermined reduced circulation rate in response to the sensed conditions.

It is a feature of this invention to automatically measure and record drill pipe circulation pressures for a range of mud pump circulation rates, and use this invention to better control the process of circulating a kick out at a well.

A significant feature of the invention is that the flow rate from the fluid pump and the position of the drilling fluid choke are preferably automatically controlled when reducing the fluid circulation rate while pumping a kick out of the well. A related feature of the invention is that the controller may automatically compare monitored conditions to various fluid circulation rates from the fluid pump and the choke position at various circulation rates, and automatically reduce the fluid circulation rate to a predetermined reduced circulation rate in response to the monitored conditions. Still another feature of the invention is that the controller may automatically position the choke to hold the pressure constant, and the measured pressure may be compared with pressure data at that choke position and pump rate.

Still another feature of the invention is that the predetermined reduced circulation rate determined by the controller may be a function of a number of unacceptable monitored conditions. The lowest reduced circulation rate for any of the monitored conditions may be used as the controlling rate.

Still another feature of the invention is that the controller may increase fluid circulation rate to a desired high fluid circulation rate in response to monitored conditions after reducing the circulation rate to the predetermined reduced circulation rate. While at the reduced circulation rate, possible problems in the circulation system may be more easily detected.

Still another feature of the invention is that the monitored conditions may include two or more of an alarm condition, fluid circulation rate change, lost circulation, plugging of the bit nozzles, choke wash out, mud-gas separation system operation, fluid pressure in the circulating system, sensor failure, choke control operation, and fluid temperature in the circulation system.

It is an advantage of this invention to utilize an automated control system to better monitor and control the operation of the well circulation system while circulating a kick out of a well.

It is also a significant advantage of this invention to expedite the process of circulating a kick out of a well bore, thereby decreasing the time required to regain well control and decreasing well bore drilling costs.

It is further an advantage of this invention to improve control of surface equipment while circulating a kick out of a well by utilizing a control system to automatically regulate pump rates and choke positions.

It is an additional advantage of this invention to improve the safety of circulating a kick from a well bore utilizing a programmable control system. The control system may consider sensed measurements of well bore and drill string pressures, circulation rates, mud weight, and well bore dimensions, and in response to these monitored conditions, automatically reduce the fluid circulation rate, with reduced potential for miscalculation or manual control errors.

These and further objects, features, and advantages of the present invention will become apparent from the following detailed description, wherein reference is made to figures in the accompanying drawing.

DETAILED DESCRIPTION OF PREFERRED EMBODIMENTS

Figure 1:
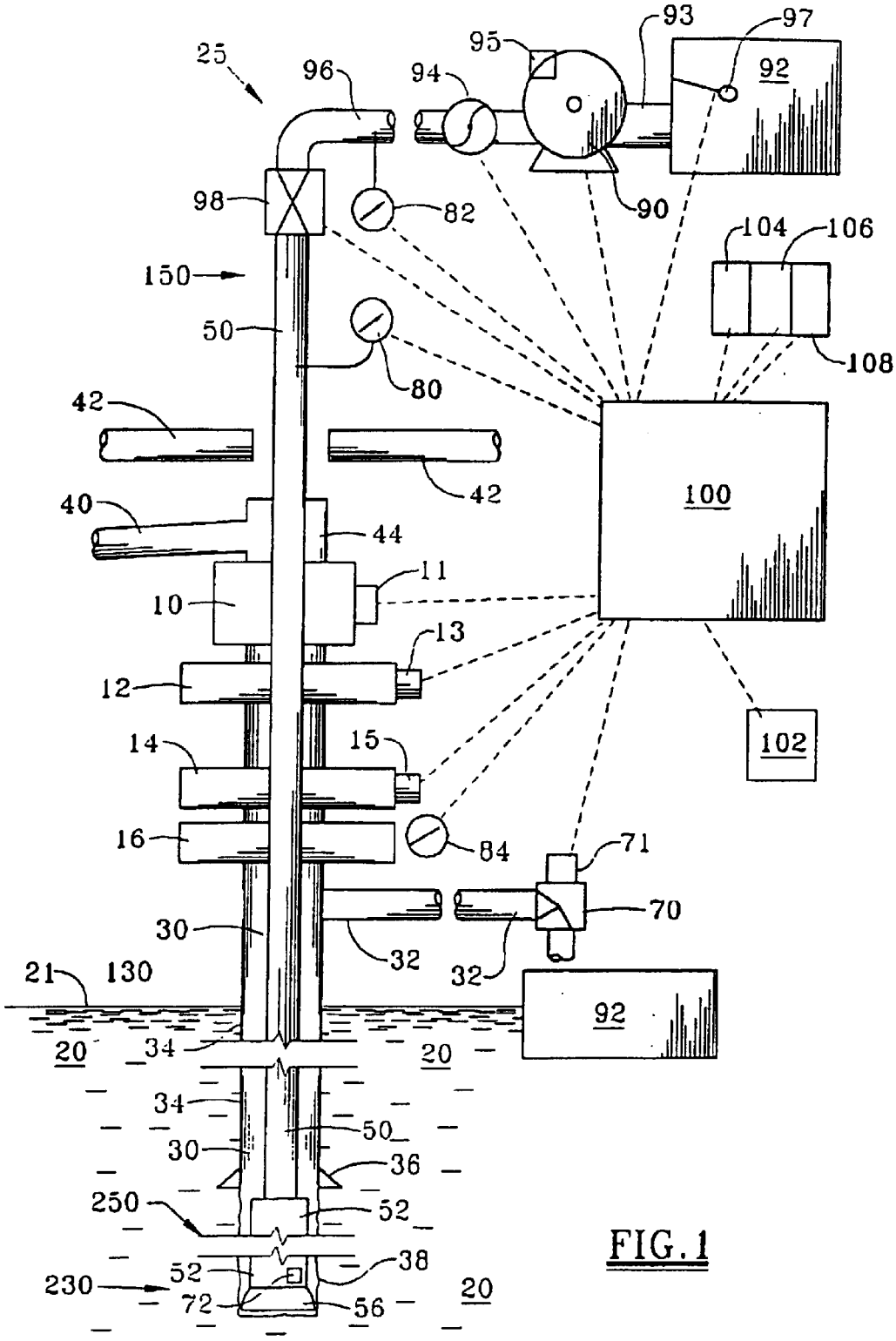
FIG. 1 is a conceptual diagram of a suitable system for circulating a kick out of a well bore and killing the well according to the present invention, including a programmable controller, sensors and regulators.

FIG. 1 illustrates components that may be included in a system for practicing the present invention. A suitable system may include a drilling rig 25 including a rig structure 42 and a drill string 50 at least partially supported by and extending from the drilling rig 25 through earth surface 21 substantially adjacent the rig 25. An upper end 150 of the drill string may extend above the surface 21, and a lower end 250 of the drill string may extend through the surface 21 and at least partially into a well bore 30 penetrating one or more subterranean formations 20. The drill string 50 may comprise a series of interconnected joints of drill pipe and may include a through bore to conduct a drilling fluid ("mud") through the drill string 50. The lower end of the drill string 250 may include a set of drill collars 52 and a drill bit 56.

When drilling, the drill bit 56 and at least a portion of the drill collars 52 and the lower end of the drill string 250 may extend into an open hole section 38 of the well bore 30, substantially within a lower portion 230 of the well bore. An upper portion 130 of the well bore may include a casing string 34 cementedly secured within the well bore 30. A lower end of the casing string 34 may include a casing shoe 36, near an upper end of the open hole section 38 of the well bore 30. The cased section of the well bore and the open hole section 38 of the well bore 30 may substantially comprise an interior chamber extending to and within the formation 20.

Drilling fluid may be treated and/or stored in one or more mud tanks 92, which may provide drilling fluid to one or more mud pumps 90, through mud pump suction line 93. A mud pump 90 located near the drilling rig 25 may pump drilling fluid through a mud line 96, then into the upper end of the drill string 150, then through a drill pipe valve 98, then through the drill string 50, and then through the drill bit 56. The drilling fluid may then exit the drill bit 56 and circulate from the lower end of the well bore 230 through a well bore annulus between an OD of the drill string 50 and an ID of the well bore 30 to the upper end 130 of the well bore. The drilling fluid may then exit the well bore selectively through either a mud return line 40 or a choke line 32, and then flow into a mud treating system 92. A bell nipple 44 may be provided to direct the returning drilling fluids from the annulus to the mud return line 40 and then to the mud treating system 92.

One or more of an annular blow out preventer 10, pipe rams 14 and 16, and/or blind rams 12 may be provided near an upper end of the well bore 130 to selectively enclose the upper end of the well bore 30. An actuator/position sensor 11, 13 and 15 may be responsive to the controller to operate the rams, and may provide position signals to the controller for the BOP 10 and the rams 12, 14 and 16. A selectively adjustable restriction device may be provided on the choke line 32, such as a valve or choke 70, to at least partially enclose the well bore 30. It will be understood by those skilled in the art that the choke 70 is being used herein to illustrate flow control principles, and in actual practice, an arrangement of several devices may be provided and controlled. For example, a choke manifold assembly and/or a kill line assembly may be provided in fluid communication with the well bore 30.

The lower end of the drill string 250 may also include a measurement device 72, which may sense one or more drilling parameters, such as hydrostatic pressure in the well bore 30, record and/or transmit a signal representative of the measured parameters back to the drilling rig 25. The measurement device 72 may also be a measurement while drilling ("MWD") device, which may sense a plurality of additional drilling parameters, such as fluid pressure within the drill string, and drill bit 56 location relative to the drilling rig 25. Information indicative of hydrostatic pressure within the well bore may be useful in determining the density of the drilling mud.

A method for regaining and/or maintaining fluid pressure control of a well bore drilled through a subterranean formation according to this invention may be utilized after a kick is detected to circulate out the kick while circulating selected drilling fluids into the well bore. Once the well is shut in, a flow check is conventionally conducted to determine whether there is any flow from the well and, depending on flow conditions, a procedure may be adopted for circulating the kick out of the well to resume normal operations. A selected array of sensors and/or regulators may be interconnected with the controller 100. The programmable controller 100 may be routinely provided with basic well bore geometry information, such as hole size, depth, tubular sizes, lengths and taper configurations. Tubular OD and ID data may also be provided. Mud pump plunger size, stroke length, push-rod size, and pump type, e.g., duplex, triplex, quintiplex, double-acting, single-acting, each may be routinely provided the control system 100. Mud weight, viscosity, gel strength, pit volume may be provided the control system. Updating of information may be dependent at least partially upon the drilling related activity being undertaken and the present well, geological and environmental conditions. The selected signals may be automatically measured and recorded in the controller 100. Manual instruction to the controller 100, including override of operation, may also be provided. Once the well is shut in, a flow check is conventionally conducted to determine whether there is any flow from the well and, depending on flow conditions, a procedure may be adopted for circulating the kick out of the well to resume normal operations.

A programmable system controller 100 and one or more sensors 72, 80, 82, 84, 94, 95 may be included to sense and/or receive information pertaining to one or more well bore and/or drilling parameters, and to control operation of one or more components utilized in practicing the methods of this invention. The methods and systems of this invention may facilitate timely detection and correction of potential hydrostatic pressure concerns which may be encountered while circulating a kick out of the well. The system controller 100 may thus be electronically interconnected with one or more sensors that may input information to the controller 100 relevant to the one or more sensor signals which monitor circulating system conditions.

Well control problems while circulating a kick out of a well may include lost circulation; washouts in the drill string, bottom hole assembly and/the drill bit; and plugging of bit nozzles or in the drill string. The ability to identify hydrostatic complications early also may stem from an observation that, if all surface equipment and control systems are functioning properly and the system is not "in-control," then some other, not-directly measurable factor, such as a down-hole hydrostatic pressure problem, may be a likely cause of the "out-of-control" situation. Surface equipment problems, such as a choke washout, may also be detectable by the sensors. The control system may provide a suite of alarms specific to the well control plan selected, including: (1) "loss of control" on any controlled parameter; (2) inability of a mud-gas separation system to safely function, as indicated by excessive vessel pressure and/or excessive high or low liquid level therein; (3) excessive pressure at any point within the system, including annulus, piping, choke manifold and flare line; (4) sensor failure; (5) choke control command and operation; and (6) temperature and/or pressure conditions at a choke, subsea BOP or elsewhere in the circulation system indicating possible formation of hydrates.

Sensors may also be included and interconnected with the controller 100 to sense for warning signs of kicks, blowouts, lost circulation and/or hydrostatic pressure control concerns. The detector 97 may be a pit volume totalizer to monitor or sense drilling fluid volume gains and/or losses in mud tanks 92. The control system 100 may also be responsive to a densometer and/or a gas sensor to measure mud density and to sense gas cut mud in the mud returned from the well bore 30. The mud return line may include a flow or other flow sensor which may sense lost circulation problems, or a flow rate increase. A drill string weight indicator may be interconnected with the drill string 50 to sense changes in drill string weight. A sensor may be included to sense a drilling break. Each sensor may include a redundant sensor at each respective sensed position, such that each sensing act is performed by two or more sensors at each location. Thereby, sensed information from each sensor at a respective position may be compared to the other sensed information at that respective position to determine the accuracy, variance, and/or reliability of the sensed value. Statistical process control techniques may also be used to make this comparison. In each case, sensing may be followed by measuring, recording, detecting and/or analyzing the signals.

In response to a sensed warning of a potential problem in the circulating system while circulating a kick out of the well, the controller may warn, prompt for an instruction/direction, and/or automatically execute shut in procedures. The particular shut in procedure to be executed may be determined or selected automatically by the controller, dependent at least partially upon the type of drilling rig 25 in use and the drilling operation being performed when the kick is detected. For example, an immobile rig may follow a different shut in procedure from a floating rig, and a different procedure may be executed when drilling as compared to when tripping the drill string. If a shallow blow-out is encountered, a diverter procedure may be executed.

The controller 100 may also execute the selected shut in procedure if the decision is made to shut in the well while circulating out a kick. To shut in a well bore, typically, a BOP 10, or rams 12, 14, 16, may be closed on the drill string 50, the choke 70 closed, and the mud pump 90 stopping mud circulation. Shut in pressures may be sensed in each of the drill string 50 and the well bore annulus 30, e.g., by pressure sensors 82 and 84, respectively. The controller 100 may then calculate or determine a kick pressure in the well bore, such as the sum of the shut in drill pipe pressure plus the hydrostatic pressure. The kick pressure may be maintained as a substantially constant bottom hole pressure by the controller 100 while again circulating the kick out of the well bore 30 and while circulating a selected fluid into the well bore 30.

Controller 100 is also capable of removing the kick fluid without a shut in period to obtain data after a potential problem in the circulating system is detected. When a problem is detected while circulating out a kick, the controller may automatically reduce the circulation rate to a predetermined rate, then continue to circulate out the kick starting at the reduced rate using either the Driller's method or the Wait and Weight method. Drill string friction data previously collected when the kick was assumed to not be in the well, such as during the previous drill pipe stand connection or disconnection, may be known to the controller 100, which includes a computer and input instruction means. While circulating the kick out of the well, the controller may maintain a substantially constant bottom hole/kill pressure on the formation by regulating the choke 71. The programmable controller 100 may also control the percentage that the drilling fluid choke is open, relative to being fully closed and fully opened, such that while pumping the selected fluid the bottom hole/kill circulating fluid pressure remains substantially constant and at least as great as the bottom hole kick pressure. The controller 100 may also ensure that the bottom hole circulating fluid pressure does not exceed a formation fracture pressure, either calculated, estimated or determined previously by the controller.

After removal of the kick from the well, the controller may temporarily cease pump circulation, collect appropriate pressure data, and then continue pumping. An advantage of such technique may be elimination of further kick influx during the initial shut in period, such as may be experienced under prior art practices. A disadvantage of not having the initial shut in drill pipe pressure may be less confidence in the determination of influx formation pressure. However, increased safety by using the controller and the ability of the controller and sensors to readily and rapidly implement changes in well bore hydrostatic pressure profiles enable the techniques of this invention to provide a safer, more reliable approach.

The controller 100 may also determine an influx gradient for the kick fluid that entered the well bore 30. The controller may also determine the weight/density required of the second fluid, e.g., the kill fluid, to kill the well or regain hydrostatic control. Thereafter, the controller 100 may execute a known procedure to circulate the kick out of the well. The controller 100 may control the mud pump 90 to pump a selected fluid into the drill string 50 at a selected kill flow rate and a circulating drill pipe kill pressure, through the drill string then through the annulus of the well bore, and then substantially back to the drilling rig. While pumping the selected fluid, the circulating drill pipe kill pressure may follow a pressure schedule determined by the controller 100.

Controller 100 may further include an operator control assembly 104, 106, 108, such as a control console with control components for selectively adjusting the programmable controller 100 and/or regulated components, such as the choke 70 and/or the mud pump 90, during the procedure. An operator controller 104 may be included for making operational changes, such as pump rate changes, during execution of a control procedure that may be controlled by the controller 100. A controller programmer 106 may also be included to facilitate altering the programming of the controller 100, such as switching from the Driller's method to the Wait and Weight method or inputting a revised drill string dimensional value, such as the length of a segment of the drill string 50. A data introducer 108, such as a key-board, may be included to facilitate inputting data into the programmable controller 100. The data introducer and/or the operator controller may be comprised of known data input components, such as a key-board, a joy-stick, buttons, switches or other manipulative devices, and/or electronic signals.

The controller 100 may also include a display 102, such as a video screen, LED readout, and/or a printed record of parameters, to facilitate visually monitoring pressures, calculated parameters, and progress of the circulation/kill procedure for controlling the kick out at the well, as a function of time or another variable. The programmable controller 100 may regulate controlled components of the rig, either electrically, mechanically, hydraulically and/or pneumatically. In addition, some rig components may be operated by the control system, while still other components may be substantially simultaneously operated manually. Selected components such as the choke 70, the BOPs 10, rams 12, 14, 16, and the mud pump 90, may be selectively operated manually and/or by the programmable controller 100. The controller 100 may also be integrated into an automatic drill system, whereby various components comprising the drilling rig, such as the draw-works, rotary, and/or a top drive, may be at least partially controlled by the programmable controller 100. The programmable controller may control an axial position of the drill string 50 relative to the well bore 30. For example, when a kick is sensed, the programmable controller 100 may cause the draw-works to pull the drill string 50 up the well bore 30 for a distance such that the rams may be closed without closing the BOP rams on a joint in the drill string 50.

When the control system is in control and an alarm or unacceptable signal occurs, the control system may automatically reduce the circulation rate to a predetermined rate and adjust the control parameters automatically. Conversely, if the control system reduced the circulation rate to a predetermined rate in response to the alarm, and the alarm condition is cleared up, the control system may therefore increase the circulation rate automatically to a desired or determined rate. The controller 100 may control the system to safely and accurately circulate out a kick in a reduced amount of time and within operating limits set by the operator. An operator may also interact with the control system to manually control pump rate while having the control system operate the choke. In the event an alarm condition is sensed, the operator may elect to continue manual control of the pump or may allow the control system to take over pump control.

The operator also may program the control system 100 to use any of the current well control techniques, such as the Driller's method and/or the Wait and Weight method, in manual and/or automatic mode of control. For example, the operator may plan to circulate a kick out of the well bore at one circulation rate, which the control system may execute. However, if during execution any complications are detected by the operator or the control system, then the control system may reduce the circulation rate to a predetermined rate. The control system preferably is programmed to not increase the automatic pump rate above the operator-specified set-point pump rate.

In the event that well control is not regained after reducing the circulation rate to a predetermined rate, determined as a function of the detected signals, or by executing one or more well control procedures, or if the quality of data provided the controller is questionable or erroneous, the controller 100 may include the capability to implement an Emergency Shut Down (ESD) of the well, the drilling equipment and/or the pumping equipment. An ESD procedure may include automatic operation of one or more components of equipment and/or providing the operator with guidance on manual actions. The controller 100 may also operate secondary supporting equipment as part of the control scheme. For example, in the event of excessive gas-mud separator pressure, the controller may shut in the well and open a "blow-down line" to reduce the pressure.

Those skilled in the art recognize that it is difficult to coordinate the control of both the pump speed and the choke at the same time to produce the desired circulation rate and pressure. According to the present invention, the reduced pump rate will match a preselected schedule or suitable range for a specific and/or detected problem. The controller may guide the operator through circulation rates, and/or may set the circulation rate. When the operator and/or the controller is changing the circulation rate, whether for start up, shut down, or rate change, the choke may be operated to hold the casing pressure constant, then the new drill pipe pressure compared with the previously recorded or estimated value at that rate. Preferably the controller 100 has automatically collected and recorded various circulation data, rather than manually collecting and inputting this information to the controller, including the minimum pump rate for extended periods to maintain circulation, and the minimum pump rate for MWD data transmission. According to the present invention, this comparison may be made automatically and provides the operator with the decision to change the rate, or to activate an automated alarm system. By reducing the rate to a preselected and thus known value, the operator is better able to trouble shoot a potential problem since the fluid circulating system under that condition is known to the drilling operator and the controller. Not only will the constant flow rate time be maximized, but the controller and/or the operator may more easily recognize a fluid circulating system problem since various well conditions at that constant reduced flow rate will likely be better known and understood. If desired, well circulation reduction and subsequent increase may occur automatically in response to similar conditions. Successful procedures to overcome specific fluid circulating system problems may be input to the controller.

The present invention thus reduces the well circulation rate in the event of a problem or an anticipated problem. The detected problem would automatically control the pump rate to a reduced, preselected rate as a function of the problem. For example, if fluid pressure at location A rises above an acceptable value, the pumps may automatically reduce circulation to a selected low rate, e.g., 30% of normal flow rate, with that rate being sufficient to maintain circulation in the well. In response to a different problem B, the circulation may be reduced to 50% of the normal rate. The controller may automatically reduce the circulation rate to the lowest rate selected for the problems detected, e.g., the 30% rate in response to problem A would control over the 50% rate prescribed for problem B if both problems A and B were detected. Alternatively, the controller may reduce the rate to a different preselected low rate when a particular combination of problems are detected. The controller 100 may also determine that, in the event a selected number of selected alarms or limits are exceeded, the well will be automatically shut in. The controller 100 may detect and record the final flow rate at pump shutdown pursuant to an established ESD program.

It is important to the present invention that the drilling operator know and understand the selected low pump rate, so that the circulation rate may thereafter be reliably increased once the detected problem has been resolved. Since the reduced flow rate is a predetermined rate in response to a schedule of selected problems, time spent at a constant reduced rate may be maximized, thereby yielding a higher chance of detecting complications.

Figure 2:
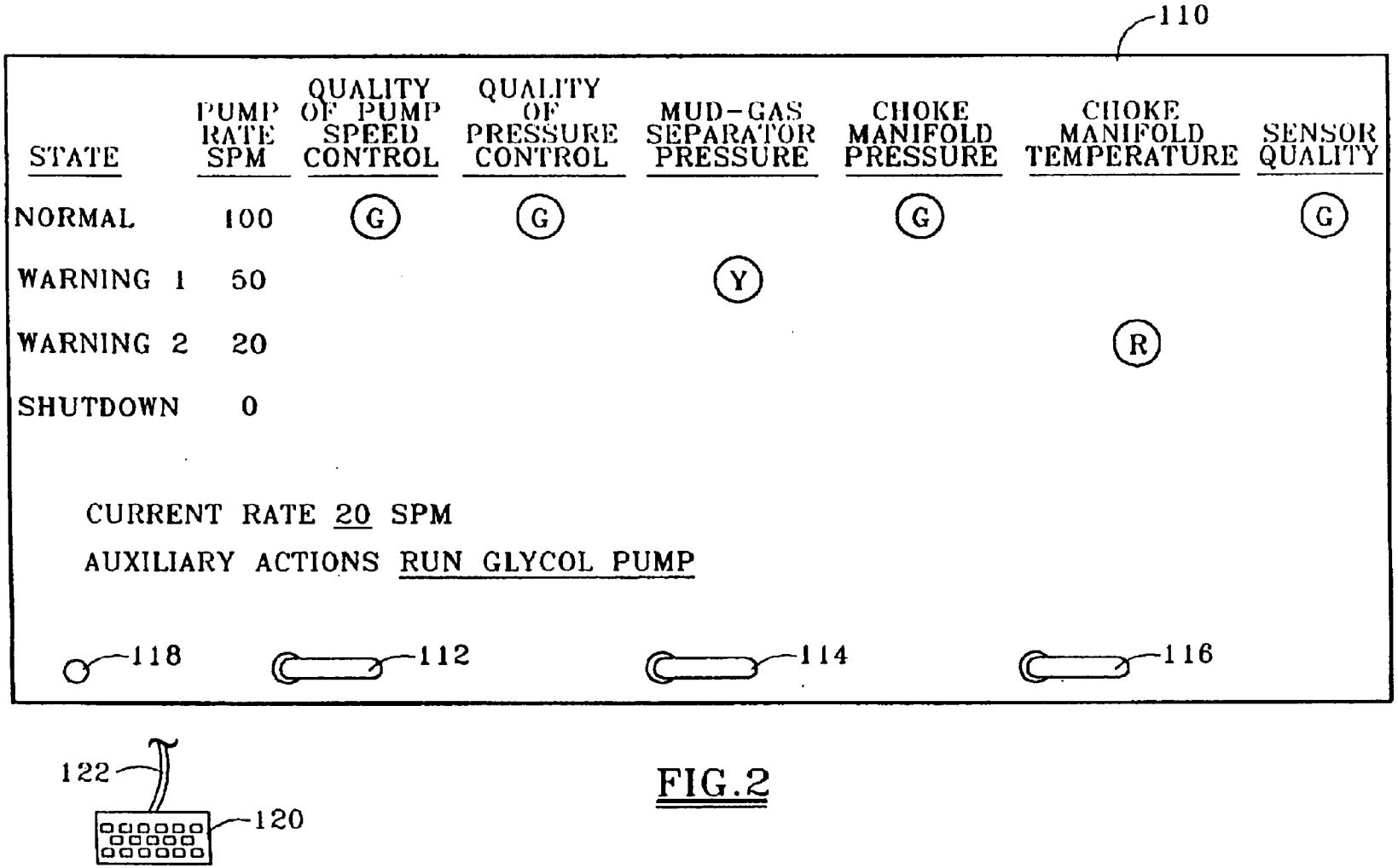
FIG. 2 illustrates an exemplary control panel according to the present invention for controlling circulation rate in a well while circulating a kick out of the well.

FIG. 2 illustrates a suitable control panel 110 for use by a drilling operator while controlling circulation while circulating a kick out of the well. A green light may indicate a sensed condition which is normal, yellow may indicate a warning condition, and red may indicate an unacceptable fluid circulation system condition which may result in the well being again shut in, or alternatively may result in the pump and/or choke being controlled so that circulation will continue at a preselected reduced flow rate in response to the monitored condition. A schedule of rates may be provided, and certain conditions may only result in a red light if the monitored condition continues for a selected time period, or for a certain number of times within a prescribed schedule. The preferred pump rate, whether under the normal pumping condition, when a preselected reduced pump rate condition exists, or during shut in of the well, may automatically occur as a function of the monitored conditions.

As an example, a particular well may have a fluid circulating rate while drilling of 180 pump strokes per minutes (SPM). While circulating the kick out of the well, the normal circulation rate for that well may be 80 SPM. While circulating the kick out of the well and operating at 80 SPM, one or more monitored conditions may exceed an acceptable limit, in which case the controller 100 may automatically reduce the circulation rate to a preselected rate of 40 SPM. The conditions of operating the pump and choke at both the 80 SPM rate and the 40 SPM rate will be known, e.g., at 80 SPM the drill pipe pressure may be 1,200 PSI, while at 40 SPM, the drill pipe pressure may be 350 PSI. The controller may thus automatically reduce the flow to the 40 SPM rate, and will maintain flow at that rate until the operator or the program begin to increase the circulation rate to return to the 80 SPM rate.

The control panel 110 may be provided with conventional manual controls 112 and 116, and manual override control 114. Key pads on a computer screen may alternatively also be used for manual control. Port 118 is provided for receiving input instructions along line 122 from control keyboard 120, so that the controller 100 is easily programmable through the keyboard 120.

The controller 100 according to the present invention is thus used while circulating a kick out of the well once the well has been shut in or substantially shut in. The term "circulating a kick" is intended in its normal sense to include various processes and procedures for circulating a kick out of the well so that the fluid circulation system may return to its normal condition, i.e., when fluid circulation system is not taking an influx of formation fluid.

The methods and systems of this invention are not limited to drilling installations and drilling rigs. The methods and systems of this invention may be utilized in a work-over operation, when running casing, tripping a string of pipe into or out of a well bore, when conducting completion operations, or in specialized well control operations. Those skilled in the art will thus appreciate that, although reference herein is made to well bore and/or drilling parameters, this invention pertains not only to the well bore drilling operations, but may also pertain to operations other than drilling. For example, such parameters may be sensed or monitored when performing well bore related operations such as well completion work or remedial well work. Parameters which may be sensed and input to the controller 100 may include fluid flow rate sensor 94, a volume/level detector 97 for mud tank 92, mud pump rate and/or stroke counter 95, fluid pressure in the mud system and the drill string 50, well bore pressure near the surface, and/or the positions of the choke 70, the BOP 10, and the rams 12, 14, 16, e.g., by pressure sensors 80, 82 and 84.

Equipment used may also include conventional and known non-conventional equipment, including coiled tubing units or snubbing units. Accordingly, the term "drill string" as used herein is intended to encompass any tubular string which receives fluids pumped from the surface through the string and into the well bore. The term "mud pump" refers to any pump or combination of pumps which pump the circulating fluid.

It may be appreciated that various changes to the details of the illustrated embodiments and systems disclosed herein, may be made without departing from the spirit of the invention. While preferred and alternative embodiments of the present invention have been described and illustrated in detail, it is apparent that still further modifications and adaptations of the preferred and alternative embodiments will occur to those skilled in the art. However, it is to be expressly understood that such modifications and adaptations are within the spirit and scope of the present invention, which is set forth in the following claims.

What is claimed is:

1. A method of varying fluid pressure in a circulation system while circulating a kick out of a well, the circulation system including a well bore drilled through a subterranean formation using a drilling rig, a drill string having a through bore and positioned at least partially within the well bore, a fluid pump for pumping a fluid through the drill string and into the well bore, and a drilling fluid choke in fluid communication with an annulus of the well bore, the method comprising:

pumping the fluid through the drill string, then through the well bore annulus and substantially back to the drilling rig, the fluid being pumped at a desired high fluid circulation rate;

monitoring a plurality of sensors for monitoring conditions of the circulation system while pumping the fluid; and automatically reducing the fluid circulation rate to a predetermined reduced circulation rate in response to the monitored conditions, and the predetermined reduced circulation rate is the lowest reduced circulation rate for any of the monitored conditions.

2. The method as defined in claim 1, wherein a flow rate from the fluid pump and the position of the drilling fluid choke are automatically controlled when reducing the fluid circulation rate.

3. The method as defined in claim 2, wherein the position of the choke is adjusted to hold the pressure constant, then the measured pressure is compared with existing pressure data at that choke position and pump rate.

4. The method as defined in claim 1, further comprising:

detecting possible problems in the circulation system while maintaining fluid circulation at the predetermined reduced circulation rate.

5. The method as defined in claim 1, further comprising:

after reducing the fluid circulation rate to the predetermined reduced circulation rate, increasing fluid circulation rate to the desired high fluid circulation rate in response to the monitored conditions.

6. The method as defined in claim 1, wherein the monitored conditions include two or more of an alarm condition, fluid circulation rate change, lost circulation, plugging of the bit nozzles, mud-gas separation system operation, sensor failure, choke control operation, and fluid temperature or pressure conditions in the circulation system.

7. The method as defined in claim 1, wherein various fluid circulation rates and the fluid pump rate and choke position at various circulation rates are automatically compared to the monitored conditions.

8. The method as defined in claim 1, wherein the predetermined reduced circulation rate is a function of the number of unacceptable monitored conditions.

9. A method of varying fluid pressure in a circulation system while circulating a kick out of a well, the circulation system including a well bore drilled through a subterranean formation using a drilling rig, a drill string having a through bore and positioned at least partially within the well bore, a fluid pump for pumping a fluid through the drill string and into the well bore, and a drilling fluid choke in fluid communication with an annulus of the well bore, the method comprising:

pumping the fluid through the drill string, then through the well bore annulus and substantially back to the drilling rig, the fluid being pumped at a desired high fluid circulation rate;

monitoring a plurality of sensors for monitoring conditions of the circulation system while pumping the fluid;

automatically comparing monitored conditions to various fluid circulation rates and the fluid pump rate and choke position at various circulation rates;

automatically controlling a flow rate of fluid from the pump and the position of the drilling choke to reduce the fluid circulation rate to a predetermined reduced circulation rate in response to the monitored conditions; and wherein the predetermined reduced circulation rate is a function of the number of unacceptable monitored conditions, and is the lowest reduced circulation rate for any of the monitored conditions.

10. The method as defined in claim 9, wherein the position of the choke is adjusted to hold the pressure constant, then the measured pressure is compared with existing pressure data at that choke position and pump rate.

11. The method as defined in claim 9 wherein the monitored conditions include two or more of an alarm condition, fluid circulation rate change, lost circulation, plugging of the bit nozzles, mud-gas separation system operation, sensor failure, choke control operation, and fluid temperature or pressure conditions in the circulation system.

12. The method as defined in claim 9, further comprising:

after reducing the fluid circulation rate to the predetermined reduced circulation rate, increasing fluid circulation rate to the desired high fluid circulation rate in response to the monitored conditions.

13. The method as defined in claim 9, further comprising:

detecting possible problems in the circulation system while maintaining fluid circulation at the predetermined reduced circulation rate.

* * * * *